United States Patent [19]

MacLaughlin

[11] Patent Number: 4,892,227

[45] Date of Patent: Jan. 9, 1990

[54] HIGH BARRIER PLASTIC CONTAINER AND METHOD OF MAKING SAME

[75] Inventor: Donald N. MacLaughlin, Midland, Mich.

[73] Assignee: Packaging Resources Incorporated, New Vienna, Ohio

[21] Appl. No.: 184,278

[22] Filed: Apr. 21, 1988

[51] Int. Cl.[4] ..... B65D 25/14

[52] U.S. Cl. ..... 220/450; 53/477; 156/73.5; 220/67; 264/68

[58] Field of Search ..... 215/256; 220/67, 68, 220/232, 254, 257, 258, 260, 266, 267, 269, 270, 450; 156/73.5; 264/68, 241, 248; 53/471, 477

[56] References Cited

U.S. PATENT DOCUMENTS

| | | | |
|---|---|---|---|
| 3,297,504 | 1/1967 | Brown et al. . | |
| 3,499,068 | 3/1970 | Brown . | |
| 3,800,400 | 4/1974 | Mistarz et al. . | |
| 4,212,409 | 7/1980 | Jeppsson . | |
| 4,333,585 | 6/1982 | Del Bon . | |
| 4,469,547 | 9/1984 | Mitchell et al. | 156/73.5 |
| 4,470,514 | 9/1984 | Dronet . | |
| 4,513,876 | 4/1985 | Buchner . | |
| 4,533,063 | 8/1985 | Buchner et al. . | |
| 4,548,333 | 10/1985 | Kobayashi et al. . | |
| 4,693,390 | 9/1987 | Hekal . | |
| 4,712,706 | 12/1987 | Nakata et al. . | |
| 4,735,336 | 4/1988 | Buchner et al. | 220/270 |
| 4,758,392 | 7/1988 | Collins et al. | 264/248 |

FOREIGN PATENT DOCUMENTS

| | | | |
|---|---|---|---|
| 2120200 | 11/1983 | United Kingdom | 220/266 |

*Primary Examiner*—Jimmy G. Foster

*Attorney, Agent, or Firm*—Willian Brinks Olds Hofer Gilson & Lione

[57] ABSTRACT

A high barrier container includes a barrel-shaped container body having a sealed end and an open end, and a closure member. The closure member includes a circular laminated central closure panel and a peripheral flange. The laminated central closure panel includes a top plastic layer and gas-impermeable layer bonded thereto. The closure member is spin welded to the container body such that a spin-weld interface is formed between the open-end part of the container body and the flange.

18 Claims, 2 Drawing Sheets

HIGH BARRIER PLASTIC CONTAINER AND METHOD OF MAKING SAME

BACKGROUND OF THE INVENTION

The present invention relates generally to a hermetically sealed plastic container and more particularly to a hermetically sealed plastic container in which a container closure member is friction welded to a container body.

Various methods have been employed for many years to produce easy open, pull-top closures for cans. In the past, these closures have been manufactured from aluminum and, more recently, from steel sheet stock. These closures include a pull tab and a near fracture score in the container closure to initiate removal of the tab. The contents of the package are protected from oxygen by the impervious metals utilized in the container. The closure is attached to a metal and/or plastic can body by conventional double-seaming technology.

Although these container closures are in widespread use, they are not without disadvantages. Removal of the metallic closure panel typically exposes rough, razor-sharp edges, which may inflict serious injury on consumers. These metallic containers are also not suitable for microwave cooking applications.

Plastic containers have become increasingly popular for use in microwave cooking. When consumer products are sold in plastic containers, the consumer may use the same container in which the product was sold to heat the product in a microwave oven. However, if a metallic lid or closure is used to seal the plastic can body, a metallic rim remains on the container body when the closure is removed to open the container. The metallic rim may cause field disruptions in the microwave oven, which in turn may cause serious electrical discharges within the microwave oven.

The metallic closure may also have aesthetic and marketing disadvantages, and metallic container ends may not be perceived as an upscale packaging medium.

Plastic hermetically sealed containers may also be suitable for use in applications such as aseptic, hotfill and retort applications. Such uses require a high-strength seal between the closure and the container body in addition a reliable hermetic seal.

Since it is desirable to provide a container closure which may be easily opened or removed, plastic container closures typically include a layer of tearable plastic material. Tearable plastic materials, however, are typically gas-permeable. Therefore, closures requiring a hermetic seal typically include a layer of gas-impermeable material bonded to the layer of tearable plastic. For example, U.S. Pat. No. 4,212,409 (Jeppsson) discloses a laminated easy open closure for a container. The closure includes a top plastic layer and a metallic foil layer bonded together, with a tear-line formed in the plastic layer. The tear line is provided to facilitate opening of the container to which the closure is affixed. The closure is sealed to the container body by means of a sealing laminate disposed on the bottom surface of the closure and around the outer peripheral edge of the container body.

U.S. Pat. No. 4,513,876 (Buckner) and U.S. Pat. No. 4,533,063 (Buckner et al.) disclose arrangements which provide an easy open closure made of a plastic/foil laminate in which a plastic layer is bonded to the top surface of the foil and is weakened to form a tearline. In these arrangements a second inner layer made of a plastic material such as polyethylene or polypropylene is bonded to the inner surface of the foil. The inner plastic layer is used to heat seal or weld the container closure to a container body.

U.S. Pat. No. 4,693,390 (Hekal) discloses an easy open closure which includes an aluminum foil layer and a plastic base layer. The base layer is positioned inside the closure and is provided with a score line, which facilitates the opening of the closure. The plastic container is integrally heat bonded to the plastic base layer of the closure.

These containers have the disadvantage that they are relatively expensive to manufacture. First, these arrangements typically contain two layers of plastic, one bonded to each surface of the barrier material. The bottom layer of plastic is provided to seal the closure to the container body. This additional plastic layer increases the cost of materials for the container. Second, if an injection molding process is used to manufacture the plastic container components, the additional second plastic layer complicates the manufacturing process. Typically, one of the plastic layers is first injection molded onto the layer of barrier material. The second plastic layer is subsequently added in a separate process step. Thus, the manufacture of this three layered closure is relatively time consuming.

As discussed above, several applications require plastic containers which have a high-strength, reliable seal between the container body and the container closure. The process of friction or spin-welding has been heretofore used to provide a high-strength seal between a plastic container and a plastic closure. For example, U.S. Pat. No. 3,800,400 (Mistarz) U.S. Pat. No. 3,499,068, (Brown); and U.S. Pat. No. 3,297,504, (Brown, et al.) teach spin-welding methods and apparatus for assembling and joining thermoplastic container sections, which patents are incorporated herein by reference.

It is therefore an object of the present invention to provide a plastic hermetically sealed container which has a high-strength seal between the container body and the closure.

It is another object of the present invention to provide a container which may be easily and economically manufactured.

It is still a further object of the present invention to provide a hermetically sealed plastic container which may be easily opened.

SUMMARY OF THE INVENTION

To achieve the foregoing and other objects and in accordance with the purposes of the present invention, the high barrier container of the present invention may comprise a barrel-shaped container body having a sealed end and an open end, and a closure member for sealing the open end of the container body. The closure member includes a top circular central closure panel and an integrally formed peripheral flange. A gas-impermeable barrier layer is bonded to the bottom surface of the plastic layer of the central closure panel. The central closure panel covers the opening in the container body. The closure member is spin-welded to the container body such that a spin-weld interface is formed between the container body and peripheral flange.

The spin-weld forms a total fusion zone between the closure and the container. The total fusion zone provides enhanced strength and hermetic reliability at the seal between the closure and the container body. The barrier member by virtue of its impervious nature and its strategic location prevents the ingress of oxygen into the package and the egress of aromatic compounds from the package.

Additional objects, advantages and novel features of the invention will be set forth in part in the description which follows, and in part will become apparent to those skilled in the art upon examination of the following or may be learned by practice of the invention.

DETAILED DESCRIPTION OF THE PRESENTLY PREFERRED EMBODIMENTS

Figure 1:
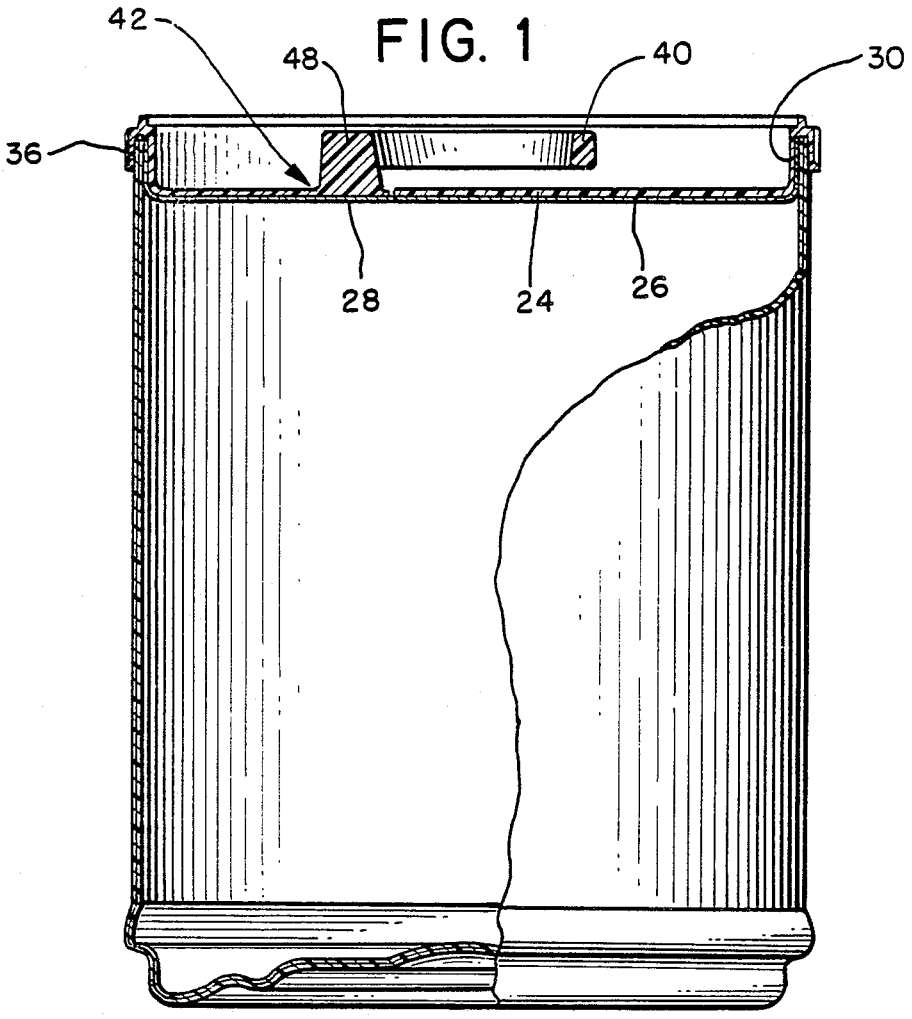
FIG. 1 is a cross-sectional view of a first preferred embodiment of the container of the present invention showing the body assembled with the closure member.
Figure 2A:
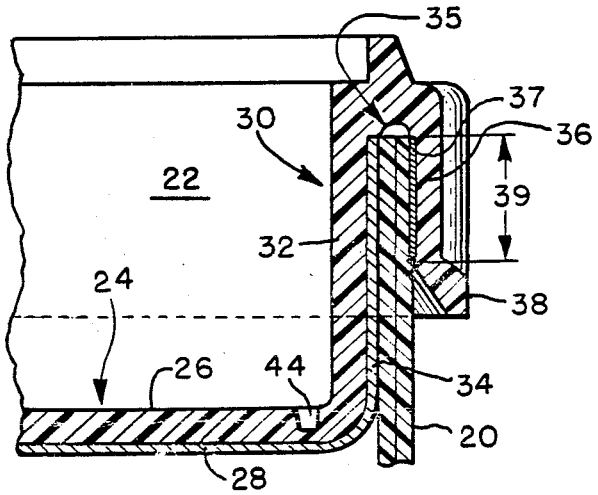
FIG. 2*a* is an enlarged fragmentary view of the container body and closure member of FIG. 1.

Referring specifically to FIGS. 1 and 2*a*, a container 10 includes a barrel-shaped container body 20 and a laminated closure element 22. The closure element includes a top layer of a tearable thermoplastic and a bottom barrier layer of a gas-impermeable material. In this description an inner or bottom direction refers to the direction facing the interior of the container 10 and an upwardly, outer, or top direction refers to a direction away from the interior of the container 10.

The plastic layer of the closure member 22 includes a circular central closure panel 26, an annular collar 32 which extends upwardly from the central closure panel 26 and an outer flange 36 joined to the top peripheral edge of the collar 32 such that a rim 35 is formed therebetween. The central closure panel 26 is dimensioned to cover the opening in the container body 20.

The plastic central closure panel 26, collar 32, flange 36 and rim 35 are preferably formed as integral components, such as by injection molding them to form a single plastic member. The plastic layer of the closure member 22 may be made of any appropriate tearable thermoplastic material such as a tearable polypropylene.

A circular, bottom barrier layer 28 made of a gas-impermeable material is bonded to the plastic layer 26 thereby defining a laminated central closure panel 24. The barrier layer extends at least to the inner surface of the container body 20 and preferably includes a collar section 34 formed as an integral component. The collar section barrier layer 34 extends upwardly from the central closure panel and preferably to the top of the container body 20. The collar section barrier layer is bonded to the outer peripheral surface of the plastic collar 32, thereby defining a laminated collar section 30. A suitable gas impermeable barrier material may be a metallic foil and preferably is an aluminum foil.

An annular groove is defined between the flange 36 and the laminated collar 30. The annular groove receives the open end of the container body 20 when the container 10 is closed. The annular groove is dimensioned to provide an interference fit between the inner surface of the flange 36 and tee outer surface of the container body 20. Preferably the flange 36 includes a flared section 38 at the bottom end, which facilitates engagement of the closure member 22 with the container body 20.

The closure member 22 is integrally attached to the container body 20 by spin-welding the closure member 22 to the body 20 using conventional spin-welding techniques such as those taught by Brown et al. The container body 20 is filled and fixed in a non-rotatable position. A tool member, adapted to fit into the closure member 22, grips the closure member 22 by means of drive lugs 41. The tool member and the closure member are rotated at a predetermined angular velocity thereby providing a predetermined moment of inertia for the spinning elements. The tool member and the closure element 22 are then released by the rotating member and glide to the mating section of the container body 20. The inertial energy of the rotating parts is dissipated by the friction provided at the interfering surfaces fit between the closure member 22 and the container body 20. The heat generated by the dissipated inertial energy imparted at the interfering surfaces welds the surfaces thereby forming a weld interface therebetween. The predetermined angular velocity of the tool member and the closure member 22 is a function of the inertial energy required to form the weld around the circumference of the container and is typically between 2800–4000 rpm.

In the preferred embodiment illustrated in FIGS. 1 and 2*a*, the two members 22 and 20 are spin-welded such that a welded interface 37 is provided between the inner surface of the peripheral flange 36 and the outer surface of the top of the container body 20. The length of the friction weld interface is represented by arrows 39 in FIG. 2*a*. A circumferential weld area is provided around the entire perimeter of the container 10.

Figure 2B:
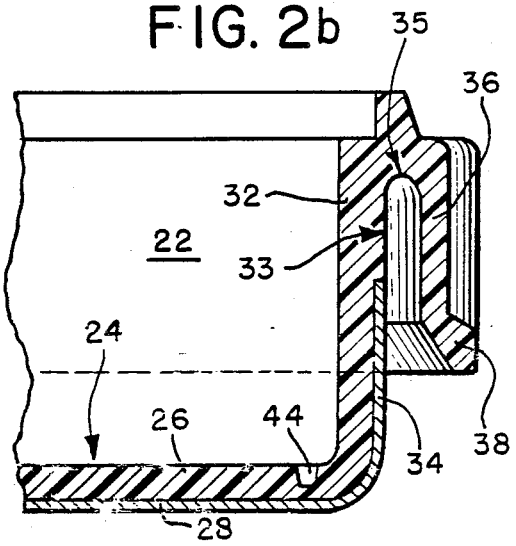
FIG. 2*b* is an enlarged fragmentary view of closure member of FIG. 1.

It will be apparent to those skilled in the art that the spin-weld interface may be formed at other zones. For example if the collar barrier element 34 of collar 30 does not extend to the top of the container body 20, as illustrated in FIG. 2*b*, the closure member may be spin-welded to the container body 20 such that the spin-weld interface is formed at area 33, between the end of the barrier element 34 and the top end of the collar 30. In this arrangement the closure member is spin welded to the inner surface of the container body 20.

Alternatively the spin-weld interface may be formed between the inner surface of rim 35 and the top of the container body 20.

It will be recognized by those skilled in the art that closure member 22 may include a thin coating material (not represented), such as an emulsified polypropylene, on the bottom surface of the barrier layer members 28 and 34 to protect the barrier layer from possible oxidation caused by the container contents.

In an exemplary embodiment, the container 10 is provided with an easy open pull tab mechanism. The easy open pull tab mechanism may comprise a pull tab or ring 40 formed as an integral part of the plastic layer 26 of the circular closure panel 24 and attached by a lift force director 48 having sides that convey to a point 42.

Figure 3:
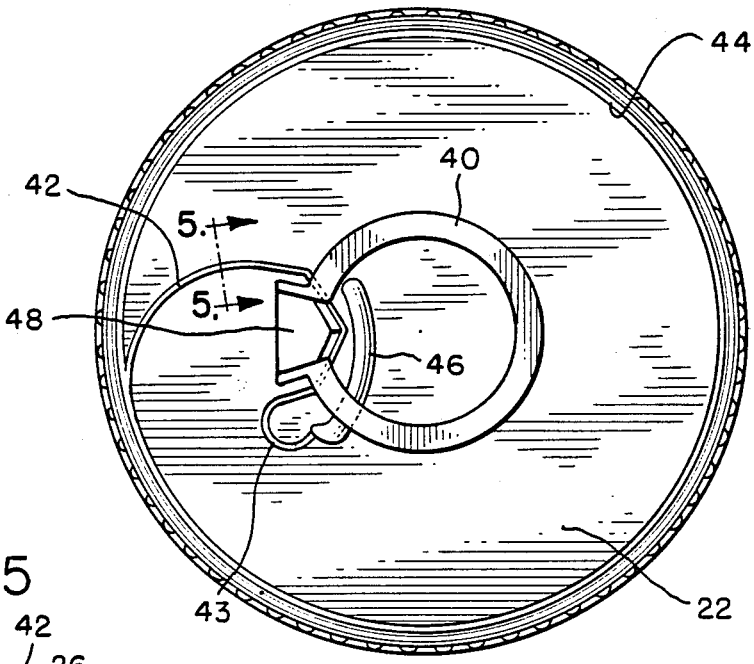
FIG. 3 is a top view of the embodiment of FIG. 1 with a tear director provided around the entire circumference of the closure panel.

FIG. 3 illustrates a first preferred embodiment of the closure member 22, which includes an easy open pull tab mechanism. A pull ring 40 is attached to the central closure panel 22. Spiraled score lines 42 and 43 and circumferential score line 44 are formed in the plastic part 26 of the laminate 24 to define tear lines in the closure member 22 for opening the container 10. The metallic foil 28, which is provided as the barrier layer 28 to protect the contents of the container, is preferably not perforated or scored. A tear direction spiral comprised of a score line 42 and score line 43 provides a path for the tear to follow to gain access to the outer rim of the closure panel and the score line 44. A cross-section reinforcing member 46 is provided in the plastic layer 26 at the end of the tear direction spiral 43 to assure that the tear in the closure member 22 terminates at the predetermined position (the end of the spiraled score line 43). The lift force director 48 is provided to initiate the plastic/foil tear. The lift force director 48 is disposed proximate to the section at which the pull ring 40 is attached.

To initiate the opening of the container, it is necessary to breach the barrier shield and the thin thermoplastic covering above it. The lift force director 48 directs the force provided by lifting the unattached part of the pull ring 40 to the point 42 where the ring is attached. Thus, the lift force director helps to initiate the primary tear with minimum exertion of force on the ring.

Figure 5:
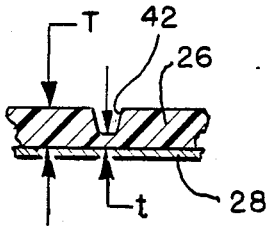
FIG. 5 is a view through lines 5—5 of FIG. 3 showing an enlarged cross-sectional view of the tear director.

The score lines penetrate the plastic layer 26 enough to facilitate opening of the container 10. FIG. 5 illustrates a cross-section of the container closure 22 which includes a score line. Generally, the thickness "t" of the scored part of the plastic layer 26 above the foil layer 28 is several times smaller than the average thickness "T" of the plastic layer 26.

Figure 4:
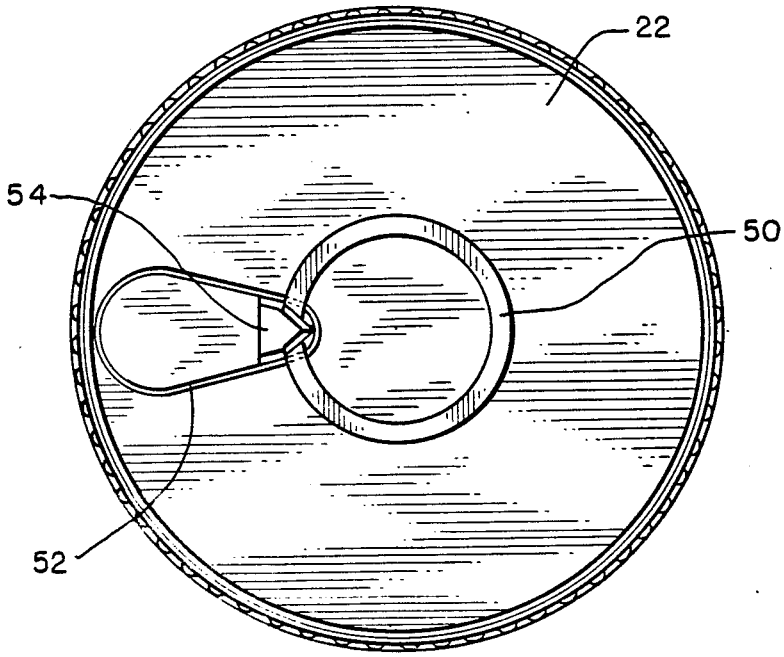
FIG. 4 is a top view of an alternate embodiment with a pour spout type opening.

FIG. 4 shows another preferred embodiment of the closure 22 which includes an easy open mechanism. In this embodiment, a score line 52 define a pour spout opening. A ring 50 is attached to the end of the area defined by the score line 52 by a lift force director 54. When the container is opened only a small pull-out section defined by the score line 52 is removed, thereby defining a pour spout in the container.

Preferably the bottom of container 10 is designed to facilitate stacking of a plurality of such containers on shelves. That is, preferably the bottom of container 10 accommodates the pull ring of the embodiments of FIGS. 3 and 4.

The barrier shield, formed by the circular gas-impermeable layer 28 of the panel 24 and the attached gas-impermeable layer of the flange 30, is bonded to the plastic layer of the closure panel 22 by an adhesive coating. The adhesive coating thickness should preferably not exceed 60 percent of the foil thickness.

In an exemplary embodiment the barrier shield is placed within an injection mold tool and a thermoplastic is then injected into the mold. The barrier shield will become bonded to the plastic closure member 26 and flange 32 by virtue of the thermal molecular bond between the adhesive on the barrier shield and injected thermoplastic.

In an exemplary embodiment the container body 20 is formed of a gas-impermeable polypropylene such as may be purchased commercially as Exxon Resin Copolymer No. 4098. The thermoplastic layer 26 of the container closure 22 is made of a tearable polypropylene such as may be purchased commercially as Shell Homopolymer No. 7C12N and has an average thickness "T" of 0.015 inches. The barrier foil layer 28 is made of aluminum foil having a thickness between 0.0005–0.0015 inches. A suitable aluminum foil precoated with a layer of polypropylene adhesive may be purchased from Heat Seal Label, Inc. of Montreal, Canada as No. 454-423. The underside of the aluminum layer 28, 34 is preferably coated with an emulsified coating of polypropylene. The score lines penetrate the plastic layer 26 such that the thickness "t" of the plastic layer above the foil is between 0.002–0.004 inches. An interference of approximately 0.018 inches per side is provided between the flange 26 and the container body 20.

In this exemplary embodiment the foil layer 34 of the collar 30 extends to the top of the container body 20. The closure member 22 is dimensioned to provide intimate contact between the collar foil layer 34 and the inner surface of the container body 20. This arrangement provides a more tortuous path for ingress or egress of materials into or out of the container when it is closed. The contacting surfaces of the collar foil layer 34 and the container body 20 thus form a seal between the closure member 22 and the container body 20.

The container of the present invention, because of its high-strength weld and high-barrier features, may be particularly useful in applications such as ambient fill, aseptic fill, hot fill and retort applications. The friction weld interface between the closure 22 and the container body 20 results in a total fusion zone between the closure 22 and the container body 20. The strength of the weld is equal to the yield strength of the base polymer used for component construction. Since the spin-welded joint extends completely around the perimeter of the container body 20, enhanced strength and hermetic reliability are achieved. The friction weld of the container 10 will exhibit enhanced reliability during rough handling such as encountered in retort operations and shipping.

The barrier shield by virtue of its impervious nature and strategic location will prevent the ingress of oxygen into the package and the egress of aromatic compounds from the package. The barrier member thus provides a significant advantage, since oxygen ingress can seriously degrade package performance with respect to shelf life, consistency, color and organoleptic quality perception.

The spin-welding of the closure and container body also brings several economic advantages. The barrier member of the closure is not used as the primary method of attachment. Thus, the barrier member thickness may be reduced. The barrier member needs to be coated on only one side with adhesive. The reduced thickness of the foil and adhesive thickness results in a closure member 22 which is easily opened.

Spin-welding the closure 22 to the container body 20 has other economic and manufacturing advantages. The spin-welding process can be used to join preformed container parts by the heat of friction and seal them in a single operation. This results in increased productivity and reduced manufacturing costs.

The foregoing description of the preferred embodiments of the present invention has been presented for purposes of illustration and description. It is not intended to be exhaustive or to limit the invention to the precise forms disclosed. Obviously many modifications and variations are possible in light of the above teachings. It is therefore intended that the scope of the invention be defined by the following claims, including all equivalents.

I claim:

1. A high barrier container comprising:

a barrel shaped gas-impermeable plastic container body having an open end and a closed end;

a container closure member comprising a top plastic layer including a circular central closure panel covering the opening in said container body and a peripheral annular plastic flange formed as an integral component thereof; and a gas-impermeable barrier layer bonded to the bottom of said plastic central closure panel;

wherein said closure member is spin-welded to said open end of said container body such that a spin-weld interface is formed directly between said container body and said peripheral flange.

2. The container of claim 1 wherein said gas-impermeable barrier comprises a metallic foil.

3. The container of claim 2 wherein said metallic foil is an aluminum foil.

4. The container of claim 2 wherein said flange extends about the outer peripheral surface of said open end of said container body such that said spin-weld interface is formed between said outer peripheral surface of said container and said inner peripheral surface of said flange.

5. The container of claim 2 wherein said flange extends about the inner peripheral surface of said open end of said container body such that said spin-weld interface is formed between said inner peripheral surface of said container and the outer peripheral surface of said flange.

6. The container of claim 2 wherein said flange extends about the outer peripheral surface of said open end of said container and includes a peripheral rim and said closure member further includes a plastic collar extending upwardly from said central closure panel and joined to said rim such that an annular groove is formed between said collar and said flange and wherein said open end of said container body engages said annular groove.

7. The container of claim 6 wherein said closure member further comprises a metallic foil collar integrally formed with said central closure panel metallic foil and bonded to the outer surface of said plastic collar.

8. The container of claim 7 wherein said spin-weld interface is formed between the outer peripheral surface of said container body and the inner peripheral surface of said flange.

9. The container of claim 7 wherein said spin-weld interface is formed between said rim and said container body.

10. The container of claim 9 wherein said annular groove is dimensioned such that an interference fit is formed between said flange and said container body.

11. The container of claim 10 further comprising pull tab opening means for opening said container, said pull tab opening means formed as an integral component of said closure member.

12. The container of claim 11 wherein said pull tab opening means comprises.

a pull tab attached to said plastic layer of said central closure panel; and a score line formed in said plastic layer of said central closure panel, said score line defining a container opening.

13. The container of claim 12 wherein said score line is provided around the circumference of said central closure panel.

14. The container of claim 12 wherein said container opening defines a pour spout in said closure member.

15. A method of forming a high barrier container comprising the steps of:

forming a plastic closure member having a central circular closure panel and an integral peripheral annular flange;

bonding a gas-impermeable barrier shield to said central closure panel;

forming a barrel shaped gas-impermeable plastic container body having an open end and a closed end; and spin-welding said closure member to said container body such that a spin-weld interface is formed directly between said container body and said flange.

16. The method of claim 15 wherein said plastic closure member is injection molded and wherein the step of bonding said barrier member to said plastic closure member comprises the steps of:

coating the top surface of said barrier member with a thermoplastic adhesive; and injection molding said plastic closure member on said barrier member.

17. The method of claim 16 further comprising the step of forming pull tab means for opening said container in said closure member.

18. The method of claim 17 wherein the step of forming said pull tab means comprises:

forming a pull tab on said plastic layer of said closure member; and forming a score line in said plastic layer of said closure member, said score line defining a container opening.

* * * * *

UNITED STATES PATENT AND TRADEMARK OFFICE

CERTIFICATE OF CORRECTION

PATENT NO. : 4,892,227

DATED : January 9, 1990

INVENTOR(S) : Donald N. MacLaughlin

It is certified that error appears in the above-identified patent and that said Letters Patent is hereby corrected as shown below:

In column 1, line 63, please delete "Buckner" and substitute therefor --Buchner--.

In column 3, line 53, after "circular" please delete --,--.

In column 4, line 3, please delete "tee" and substitute therefor --the--.

In claim 12, column 8, line 9, please delete "." and substitute therefor --:--

Signed and Sealed this

Twenty-third Day of June, 1992

*Attest:*

DOUGLAS B. COMER

*Attesting Officer*

*Acting Commissioner of Patents and Trademarks*